US005439393A

United States Patent [19]

Watson

[11] Patent Number: 5,439,393

[45] Date of Patent: Aug. 8, 1995

[54] HELICAL ZERO INSERTION FORCE CONNECTOR FOR COAXIAL CABLES

[76] Inventor: Troy M. Watson, 5672 E. Kelso, Tucson, Ariz. 85712

[21] Appl. No.: 228,820

[22] Filed: Apr. 18, 1994

[51] Int. Cl.[6] ..... H01R 17/04

[52] U.S. Cl. ..... 439/578; 439/675; 439/840; 439/268

[58] Field of Search ..... 439/268, 578, 583–584, 439/840–841

[56] References Cited

U.S. PATENT DOCUMENTS

| | | | |
|---|---|---|---|
| 2,427,001 | 9/1947 | Hubbell et al. | 173/363 |
| 3,295,872 | 1/1967 | Kragle | 287/115 |
| 3,364,302 | 12/1968 | Slick | 439/841 |
| 3,440,333 | 4/1969 | Blomstrand | 174/87 |
| 3,518,614 | 6/1970 | Nyberg | 339/74 |
| 4,082,399 | 4/1978 | Barkhuff | 339/75 M |
| 4,192,567 | 3/1980 | Gomolka | 339/75 M |
| 4,874,909 | 10/1989 | Velke, Sr. et al. | 174/845 |
| 5,042,146 | 8/1991 | Watson | 29/845 |
| 5,154,626 | 10/1992 | Watson | 439/268 |
| 5,250,759 | 10/1993 | Watson | 174/261 |

FOREIGN PATENT DOCUMENTS

| | | | |
|---|---|---|---|
| 3721965 | 7/1987 | Germany | 439/840 |

OTHER PUBLICATIONS

G. F. Kennedy and T. L. Vinson, IBM Technical Dislosure Bulletin, vol. 6, No. 1, Jun. 1963, p. 36.

*Primary Examiner*—Larry I. Schwartz
*Assistant Examiner*—Jill DeMello

[57] ABSTRACT

A coupler of the zero insertion force (ZIF) type for connecting two coaxial cables. A first embodiment includes a pair of opposed (inner) cylindrical receptacles, electrically connected, each formed from two lengths of helically coiled, interleaved wire, which each receive and grip a cable center-conductor. A pair of opposed (outer) cylindrical receptacles, electrically connected, each formed from two lengths of helically coiled, interleaved wire ribbon, each receive, contact, and grip a cable outer-conductor. The first embodiment further includes means for concurrently enlarging or contracting each (inner, outer) receptacle pair, and means for maintaining receptacle contraction. A second embodiment includes a pair of opposed (inner) cylindrical receptacles, electrically connected, each formed from a length of helically coiled wire, which each receive, contact and grip a cable center-conductor. A pair of opposed (outer) cylindrical receptacles, electrically connected, each formed from a length of helically coiled wire ribbon, each receive and grip a cable outer-conductor. The second embodiment further includes means for concurrently enlarging or contracting each (inner, outer) receptacle pair, and means for maintaining receptacle contraction.

31 Claims, 7 Drawing Sheets

HELICAL ZERO INSERTION FORCE CONNECTOR FOR COAXIAL CABLES

BACKGROUND OF THE INVENTION

1. Field Of The Invention

The present invention relates to the field of electrical connectors for coaxial cables and, more particularly, to the class of zero insertion force (ZIF) connectors having receptacles constructed of wire formed in the shape of a single- or double-helix.

In ZIF connectors, pressure between a mating pair of contacts in a male connector part and female receptacle is temporarily withheld during coupling or decoupling, typically by causing a temporary enlargement of the effective inside diameter of the female receptacle so as to disengage the male contact during insertion or removal.

The splicing of two coaxial cable ends requires first removing the insulation from each end, mounting a male fitting on each end, and then screwing the fittings onto a double-ended adapter having opposing female threads in each end. Typically, special tooling is required to apply the fittings, which if improperly applied can result in unreliable performance. The splicing process as presently practiced requires multiple successive operations which are time consuming to execute and require extensive practice to perfect.

There is thus an ongoing and unfulfilled need to easily and efficiently connect and disconnect coaxial cables to each other, whether in a stand-alone device, mounted in a panel, or mounted within electronic equipment.

2. Description Of The Related Art

The use in electrical connectors of single-helix spring coils as variable diameter clamping elements is known in the art. U.S. Pat. No. 4,082,399 to Barkhuff is directed to a ZIF connector wherein a plurality of resilient helical contact members each receive a pin of a multi-pin module.

U.S. Pat. No. 3,518,614 to Nyberg is directed to a receptacle having a plurality of coiled springs attached to and positioned between a pair of rotatable plates. When the plates are rotated with respect to each other in one direction the inner diameters of the coiled springs are simultaneously increased; when rotated in the other direction the diameters are decreased.

U.S. Pat. No. 4,874,909 to Velke, Sr. et al., is directed to a connector for butting the ends of two single-conductor cables within a helically coiled grip element.

U.S. Pat. No. 3,440,333 to Blomstrand is directed to a connector including a helically coiled spring to grip the ends of a plurality of parallel wires without resort to soldering or welding.

U.S. Pat. No. 3,295,872 to Kragle uses a single helical spring to provide a mechanical grip on a coaxial cable. The spring does not contact the outer-conductor of the coaxial cable and thus is not involved in electrical connection.

U.S. Pat. No. 2,427,001 to Hubbel et al., is directed to a panel-mounted receptacle including a coiled spring within a longitudinal chamber which receives and grips a male pin or plug. This is not a ZIF device as there is no provision to enlarge or contract the spring opening.

U.S. Pat. No. 4,192,567 to Gomolka is directed to a ZIF electrical connector including a male connector part having a plurality of prongs, and a female connector part including a corresponding plurality of receptacles, each containing a coiled spring. The connector includes means to expand or contract the coiled spring receptacles.

U.S. Pat. No. 5,042,146 to the present inventor discloses forming interconnecting hookup wire into a double-helix configuration. The double-helix serves as a receptacle for receiving component leads or other hookup wire ends for soldering, and also provides an integrally connected point-to-point hookup wiring alternative to printed circuit traces.

None of the above-cited references provide for zero-insertion force connection simultaneously to an inner conductor and an outer-conductor as exist in a coaxial cable.

U.S. Pat. No. 5,154,626 ("626") issued to the present inventor on Oct. 13, 1992, entitled "Double-Helix Zero Insertion Force Connector System", discloses a method to use an interleaved double-helix receptacle as a ZIF connector and is incorporated herein in its entirety by this reference. A double-helix, formed from a length of bared or uninsulated wire, includes a bridging loop which connects the two helix halves. Applying a rotational torque to the loop causes the receptacle opening to expand or contract.

The '626 patent primarily is directed to an embodiment where the male connector part includes a cylindrical contact pin which is engaged by a double-helix coil disposed within a female receptacle. A second embodiment of the '626 patent discloses a double-helix receptacle for connecting the bared center-conductor of two coaxial cables, but does not disclose a ZIF connector enabling coaxial cable ends to be easily and reliably connected so as to achieve strong mechanical connection as well as electrical connection between the two center-conductors and two outer-conductors.

OBJECTS OF THE INVENTION

Accordingly, it is a primary object of the present invention to provide an improved connector or coupler over current techniques to join the ends of two coaxial cables, which securely connects the cable ends mechanically while providing reliable electrical connectivity between the two center-conductors and the two coaxial outer-conductors.

Another object of the invention is to provide a connector or coupler enabling two coaxial cable ends to be connected and disconnected in a zero insertion force manner.

A further object of the invention is to accomplish zero insertion force connection or disconnection of two coaxial cable ends without applying a large rotational torque to the connector or coupler.

Yet another object of the invention is to provide a connector or coupler which when used to connect two coaxial cables results in a consistent and uniform characteristic impedance, without injecting any disruptions or noise.

A further object of the invention is to provide a connector or coupler which is of rugged construction.

Another object of the invention is to provide a connector or coupler that is simple, reliable, and easy to use.

One more object of the invention is to provide a connector or coupler that is inexpensive to manufacture.

Other objects of the invention will become evident when the following description is considered with the accompanying drawings.

SUMMARY OF THE INVENTION

The above and other objects are met by the present invention, a coupler having two opposing receptacles each including an inner, relatively small diameter single- or interleaved multiple-helix which closely receives the center-conductor of a coaxial cable, and an outer, larger diameter single- or interleaved multiple-helix which closely receives the outer-conductor. The interior cross-sectional areas of each receptacle helix pair may be contracted to contact and grip the center-conductor and outer-conductor and may be enlarged to allow easy insertion or removal of a coaxial cable. A large surface area around the circumference of a mating male coaxial cable is contacted, providing high electrical conductivity and strong mechanical gripping. By fabricating the helixes from a resilient material, the helix receptacles are self-constrictive. By providing limited slippage of a mechanism controlling the cross-sectional area of either an inner or outer helix receptacle, one helix can firmly engage its male contact before the other helix engages its contact.

A first preferred embodiment includes opposed first and second receptacle sub-assemblies disposed, respectively, within first and second cylindrical sleeves, and separated by a cylindrical insulating base. Each receptacle sub-assembly includes an inner double-helix receptacle formed from interleaved, coiled first and second bare wires and having an alterable inner circular cross-sectional area which can be enlarged and then contracted so as to easily receive and then provide constriction around a coaxial cable center-conductor. Each receptacle sub-assembly further includes an outer double-helix receptacle, generally concentric around the inner double-helix, formed from interleaved, coiled first and second bare wire ribbons and having an alterable inner circular cross-sectional area which can be enlarged and then contracted so as to easily receive and then provide constriction around a coaxial cable outer-conductor. Opposing first and second ribbons of the two opposed inner double-helixes are interconnected, respectively, by a first and second electrically conductive bridge. Opposing first and second ribbons of the two opposed outer double-helixes are interconnected, respectively, by a third and fourth electrically conductive bridge.

The first and second receptacle sub-assemblies further include, respectively, a first and second cylindrical insulating housing disposed on opposite sides of the base, which rigidly constrain the inner and outer double-helixes. Each housing is separately rotatable with respect to the base about a common axis in either rotational direction by applying a torque to a housing extension rigidly attached to the housing. Rotating a housing causes the attached inner and outer double-helix receptacles to enlarge or contract. Thus, each pair of double-helix receptacles are separately ganged to enable individual control for insertion or extraction of a coaxial cable end.

A second preferred embodiment includes opposed first and second receptacle sub-assemblies disposed, respectively, within first and second cylindrical sleeves, and separated by a cylindrical insulating base. Each receptacle sub-assembly includes an inner single-helix receptacle formed from a coiled bare wire and having an alterable inner circular cross-sectional area which can be enlarged and then contracted so as to easily receive and then provide constriction around a coaxial cable bared center-conductor. Each receptacle sub-assembly further includes an outer single-helix receptacle, generally concentric around the inner helix, formed from a coiled bare wire ribbon and having an alterable inner circular cross-sectional area which can be enlarged and then contracted so as to easily receive and then provide constriction around a coaxial cable bared outer-conductor. Ribbons of the two opposed inner helixes are interconnected by a first electrically conductive bridge. Ribbons of the two opposed outer helixes are interconnected by a second electrically conductive bridge.

The first and second receptacle sub-assemblies further include, respectively, a first and second cylindrical insulating housing disposed on opposite sides of the base, rigidly attached, respectively, to the first and second sleeves. The first and second inner helix receptacles are rigidly attached, respectively, to the first and second insulating housings; the first and second outer helix receptacles are rigidly attached, respectively, to the first and second sleeves. Each sleeve-housing combination is separately rotatable with respect to the base about a common axis in either rotational direction by applying a torque to the sleeve or housing. Such rotation causes the attached inner and outer helix receptacles to enlarge or contract. Thus, the housings and each pair of helix receptacles are separately ganged to enable individual control for insertion or extraction of a coaxial cable end.

A more complete understanding of the present invention and other objects, aspects and advantages thereof will be gained from a consideration of the following description of the preferred embodiments read in conjunction with the accompanying drawings provided herein.

BRIEF DESCRIPTION OF THE DRAWINGS

FIG. I is a partial sectional view of a first preferred embodiment, including opposed first and second inner double-helix receptacles, opposed first and second outer double-helix receptacles, first and second sleeve housings, a base, and opposed first and second housings.

DESCRIPTION OF THE PREFERRED EMBODIMENTS

I. INTRODUCTION

Figure 1:
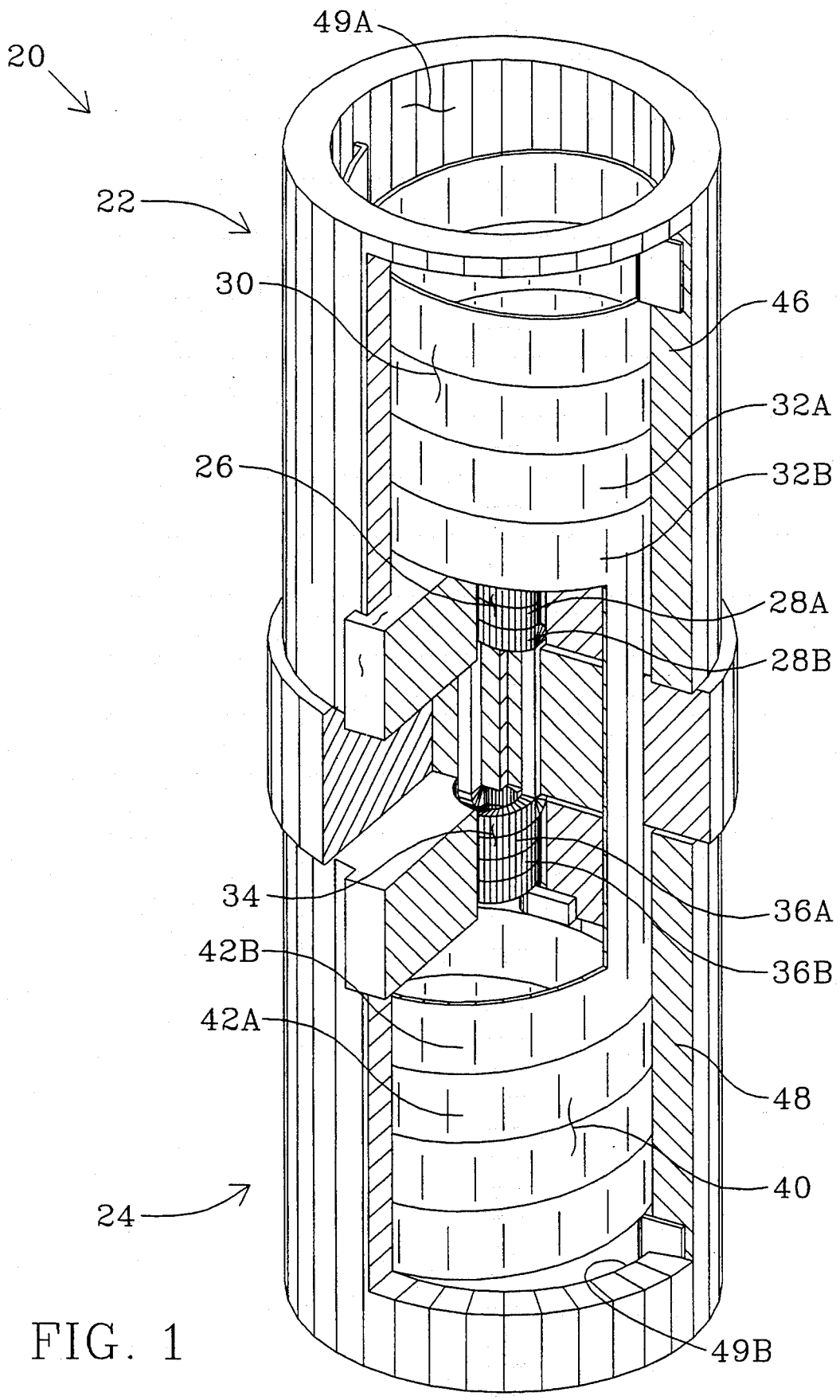

While the present invention is open to various modifications and alternative constructions, the preferred embodiments shown in the drawings will be described herein in detail. It is to be understood, however, there is no intention to limit the invention to the particular forms disclosed. On the contrary, it is intended that the invention cover all modifications, equivalences and alternative constructions falling within the spirit and scope of the invention as expressed in the appended claims.

II. FIRST PREFERRED EMBODIMENT

As shown in FIG. 1, a coupler 20 for connecting two opposing coaxial cable ends includes opposed first and second receptacle sub-assemblies 22 and 24. Sub-assembly 22 includes a first inner double-helix receptacle 26 formed from interleaved, coiled first and second bare wire ribbons 28A, 28B. Receptacle 26 has an alterable circular inner cross-sectional area which can be enlarged and then contracted so as to easily receive and then constrict around and tightly retain the bared center-conductor of a first coaxial cable within the receptacle 26. Sub-assembly 22 further includes a first outer double-helix receptacle 30, generally concentric around the inner receptacle 26, formed from interleaved, coiled first and second bare wire ribbons 32A, 32B. Receptacle 30 has an alterable circular inner cross-sectional area which can be enlarged and then contracted so as to easily receive and then constrict around and tightly retain the outer-conductor of the first coaxial cable within the receptacle 30.

Sub-assembly 24 includes a second inner double-helix receptacle 34 formed from interleaved, coiled first and second bare wires 36A, 36B. Receptacle 34 has an alterable circular inner cross-sectional area which can be enlarged and then contracted so as to easily receive and then constrict around and tightly retain the bared center-conductor of a second coaxial cable within the receptacle 34. Sub-assembly 24 further includes a second outer double-helix receptacle 40, generally concentric around the inner receptacle 34, formed from interleaved, coiled first and second bare wire ribbons 42A, 42B. Receptacle 40 has an alterable circular inner cross-section which can be enalrged and then contracted so as to easily receive and then constrict around and tightly retain the outer-conductor of the second coaxial cable within the receptacle 40.

Sub-assemblies 22 and 24 further include, respectively, generally cylindrical first and second sleeve housings 46 and 48, having first and second interior surfaces 49A and 49B, and concentric about and closely receiving, respectively, the outer receptacles 30 and 40.

Figure 2:
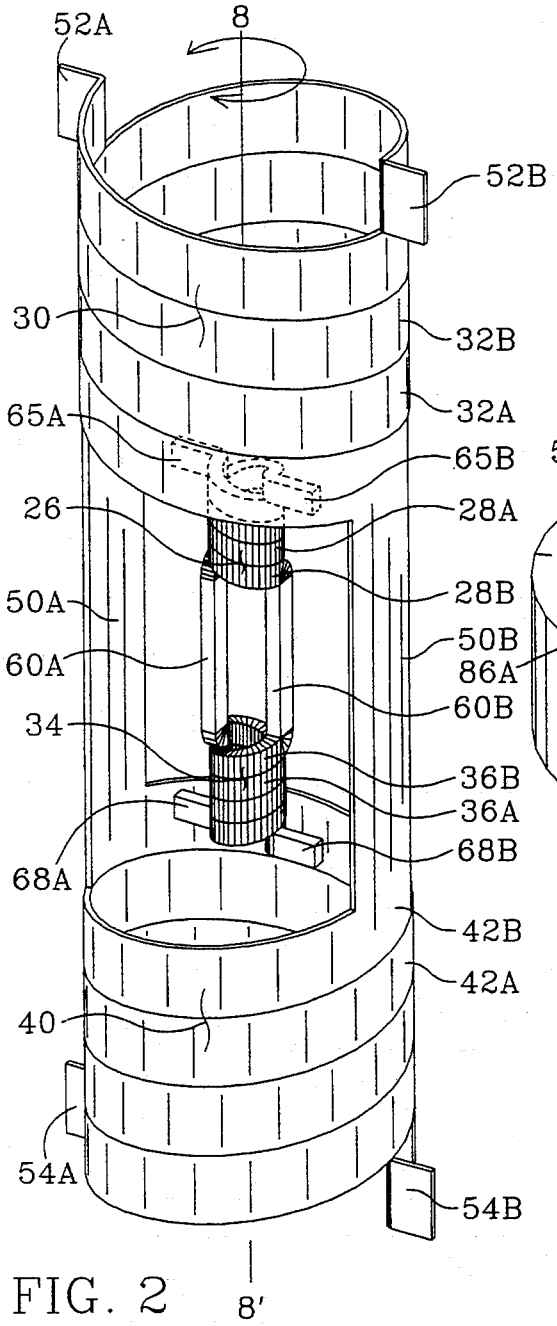
FIG. 2 is a perspective view of conductive elements of the FIG. I embodiment, including first and second inner double-helix receptacles, first and second outer double-helix receptacles, and first, second, third and fourth bridges.

As best shown in FIG. 2, ribbon 32A of outer receptacle 30 is rigidly connected to ribbon 42A of outer receptacle 40 at their opposed proximal ends by a first electrically conductive bridge 50A. Ribbon 32B of outer receptacle 30 is rigidly connected to ribbon 42B of outer receptacle 40 at their opposed proximal ends by a second electrically conductive bridge 50B. The outer receptacles 30 and 40 are rigidly connected at their opposite distal ends to diametrically opposed first and second outer-conductor helix tabs 52A, 52B and 54A, 54B, respectively.

Ribbon 28A of receptacle 26 is rigidly connected to ribbon 36A of inner receptacle 34 at their opposed proximal ends by a third electrically conductive bridge 60A. Ribbon 28B of inner receptacle 26 is rigidly connected to ribbon 36B of inner receptacle 34 at their opposed proximal ends by a fourth electrically conductive bridge 60B. The inner receptacles 26 and 34 are rigidly connected at their opposite distal ends to diametrically opposed first and second center-conductor helix tabs 65A, 65B and 68A, 68B, respectively.

Figure 3:
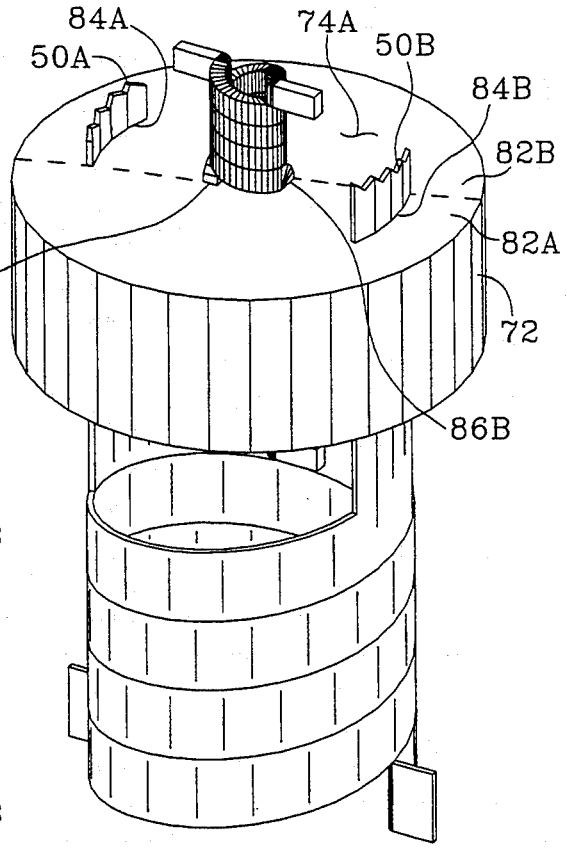
FIG. 3 is a perspective view of the FIGS. 1 and 2 first inner double-helix receptacle, first inner double-helix receptacle tabs, second outer double-helix receptacle, second outer double-helix receptacle tabs, base, and partial first and second bridges.

FIG. 3 shows a generally cylindrical insulating base 72 having a first surface 74A and an opposing parallel second surface 74B (not shown). First and second half-sections 82A and 82B include, respectively, arcuate slots 84B and 84A extending between surfaces 74A and 74B (not shown). The slots 84A and 84B closely receive, respectively, first and second bridges 50A and 50B. First and second half-sections 82A and 82B further include, respectively, slots 86A and 86B extending between surfaces 74A and 74B. The slots 86A and 86B closely receive, respectively, the third and fourth bridges 60A (not shown) and 60B (not shown).

Figure 4:
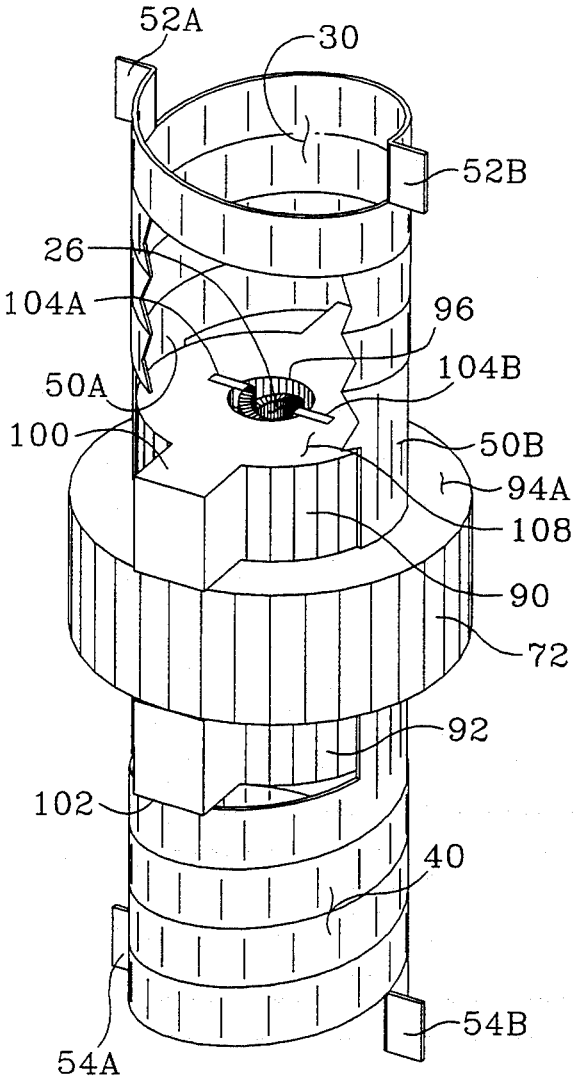
FIG. 4 is a partial sectional view of the FIG. 1 embodiment, including the first inner double-helix receptacle, first and second outer double-helix receptacles, base, first and second housings, and first and second housing extensions.

FIG. 4 shows first and second generally cylindrical insulating housings 90 and 92 fitting and rotating against, respectively, first and second smooth surfaces 94A and 94B (not shown) of base 72. The housings 90 and 92 are closely received, respectively, within the bridges 50A and 50B interconnecting receptacles 30 and 40. Inner receptacle 26 and inner receptacle 34 (not shown) are closely received, respectively, within bore 96 and bore 98 (not shown) of housings 90 and 92. Housings 90 and 92 are rigidly attached over a limited portion of their circumference to, respectively, first and second housing projections 100 and 102.

Referring to FIGS. 2 and 4, tabs 65A, 65B and 68A, 68B are closely received, respectively, within diametrically opposed slots 104A, 104B and 106A, 106B (not shown) in opposing distal surfaces 108 and 110 (not shown) of housings 90 and 92, respectively. Rigidity of bridges 60A and 60B within base 72 and constraints imposed on the distal ends of receptacles 26 and 34 by tabs 65A, 65B and tabs 68A, 68B, respectively, combine to cause inner helical receptacle 26 or 34 to coil or uncoil when housing 90 or 92 undergoes a rotational displacement about axis 8–8'.

Figure 5:
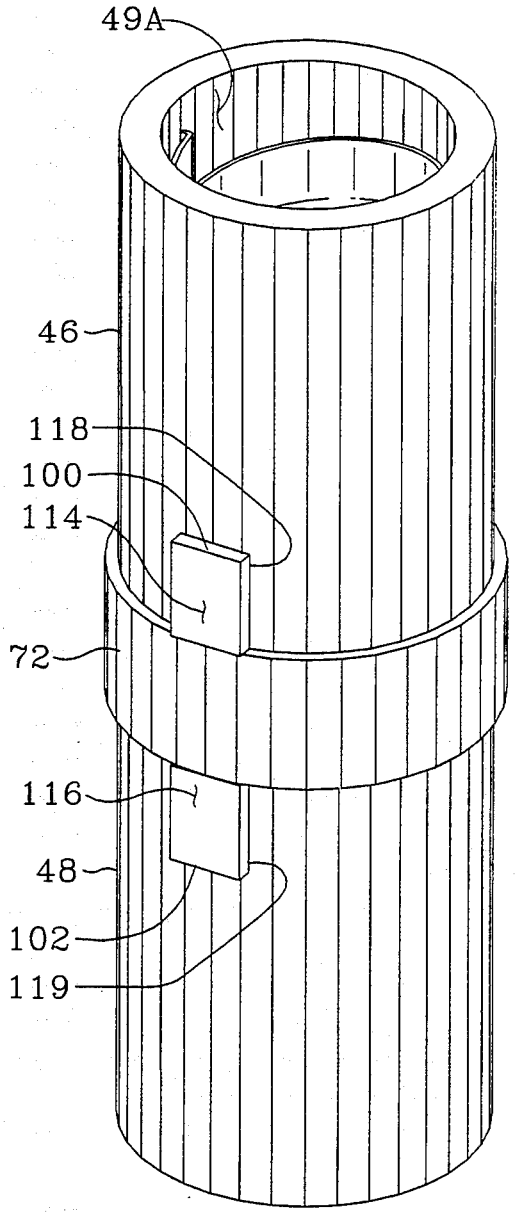
FIG. 5 is a perspective view of the FIG. 1 embodiment.

FIG. 5 shows first and second housing projections 100 and 102 including, respectively, an end 114 and 116 extending, respectively, through slots 118 and 119 of sleeve housings 46 and 48. The sleeve housings 46 and 48 can be fabricated from solid metal, an insulating material, or a dielectric material within a metal skin.

Referring to FIGS. 4 and 5, tabs 52A, 52B and 54A, 54B are rigidly received within slots at the distal ends of sleeve interior surfaces 49A and 49B (not shown). Rigidity of bridges 50A and 50B within base 72 and constraints imposed on the distal ends of the outer receptacles 30 and 40 by tabs 52A, 52B and 54A, 54B, respectively, combine to cause outer-helical receptacle 30 or 40 to coil or uncoil when sleeve housing 46 or 48 undergoes a rotational displacement about axis 8–8'. The helix pairs 30, 26, or 40, 34 (not shown), are conveniently enlarged or contracted by gripping the base 72 and applying a twisting force to sleeve housing 46 or 48.

The helical ribbons of the inner and outer receptacles can be wound either right-handed or left-handed. In FIG. 2, (28A, 28B) and (32A, 32B) are wound left-handed, while (36A, 36B) and (42A, 42B) are wound right-handed. Configurations for the ribbon pairs can mix the left- and right-handed windings. However, (28A, 28B), (32A, 32B) or (36A, 36B), (42A, 42B) must be wound in the same direction in order that the inner and outer helix pairs expand or contract together.

Figure 6A:
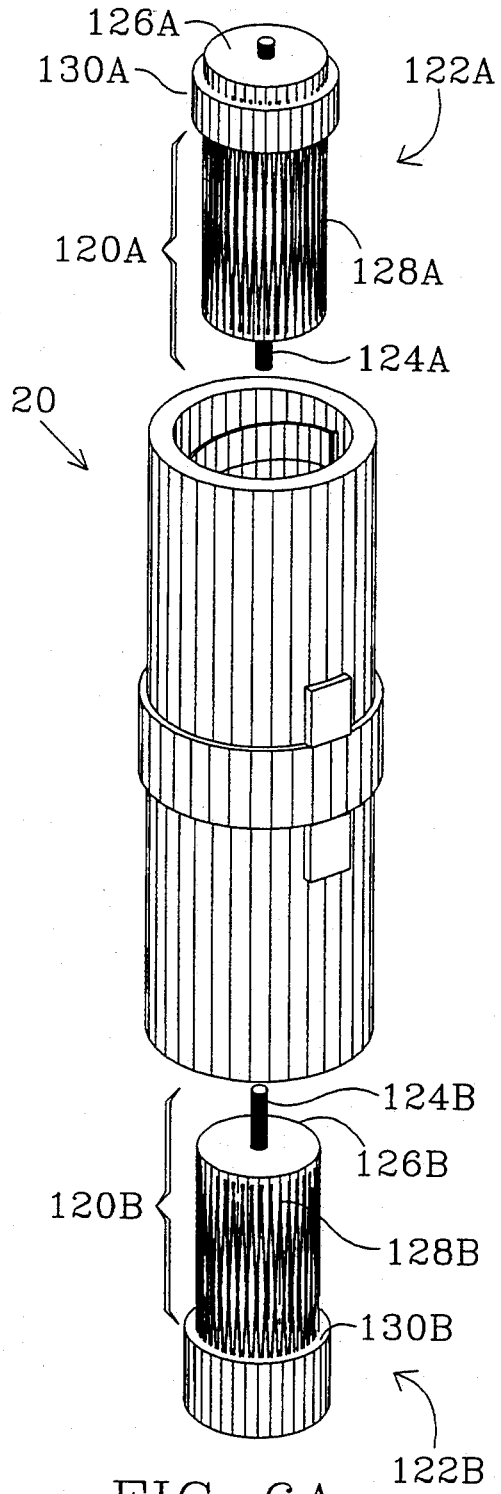
FIG. 6A is a perspective view of the FIG. 1 embodiment receiving a bared end from each of two opposing coaxial cables.

FIG. 6A shows the coupler 20 ready to receive a bared end 120A, 120B from each of two opposed coaxial cables 122A and 122B. The cable ends 120A, 120B include, respectively, a bared center-conductor 124A, 124B, a dielectric 126A, 126B, an outer wire-braid shield 128A, 128B, and an outer insulating sheath 130A, 130B.

Figure 6B:
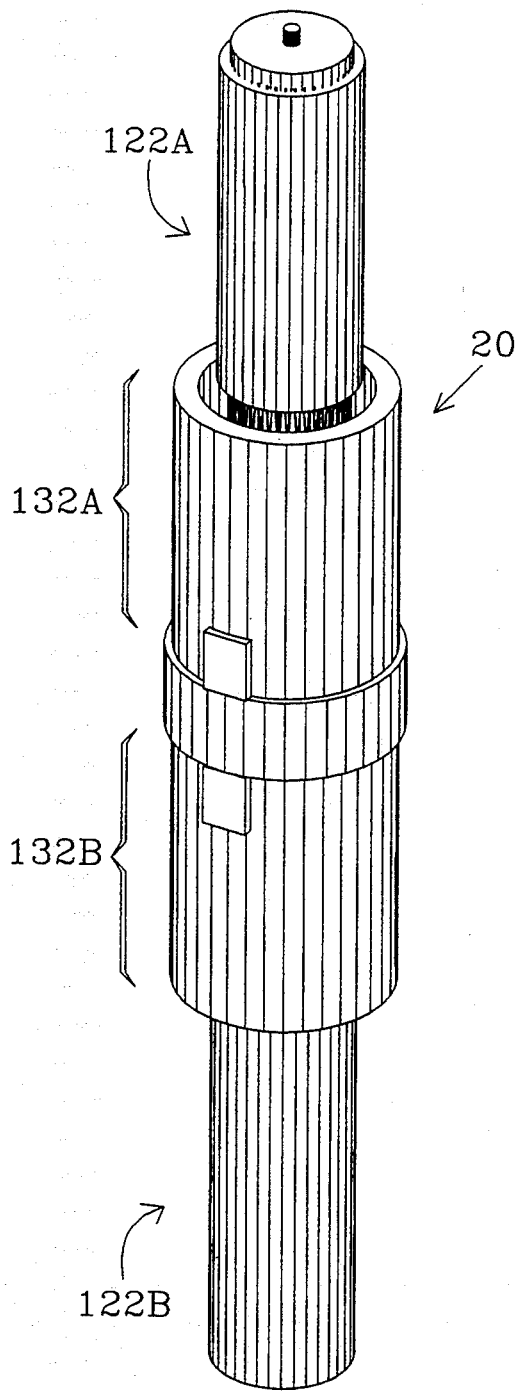
FIG. 6B is a perspective view of the coaxial cable ends inserted into the FIG. 1 embodiment.

FIG. 6B shows the coaxial cables 122A and 122B inserted into coupler 20, with cable 122A seated and locked within a region 132A of the coupler and cable 122B seated within a region 132B of the coupler. The proximal ends of the sheaths 130A, 130B are disposed external to the coupler 20.

Other types of conductors that can be contacted with a coupler of the present invention instead of the wire-braid shields 128A, 128B of FIGS. 6A and 6B include the outer conductor of a male-end connector such as the outer shield of an RCA (phono) plug, UHF-type plug, N-type plug, and any coaxial male end connector assembly having an outer conductive member and a central pin or plug.

In some circumstances, especially when utilizing helixes fabricated from resilient conducting material, a limited amount of slippage between the inner and outer helixes may be desirable to allow uniform compression of the inner and outer receptacles on, respectively, a coaxial cable center-conductor and an outer conductive shield. Such slippage may be achieved by any number of methods, such as allowing movement of the helix tabs within their respective restraining slots, or by allowing substantial rotational movement of housing projections 100 and 102 within sleeve housings 46 and 48.

Figure 7:
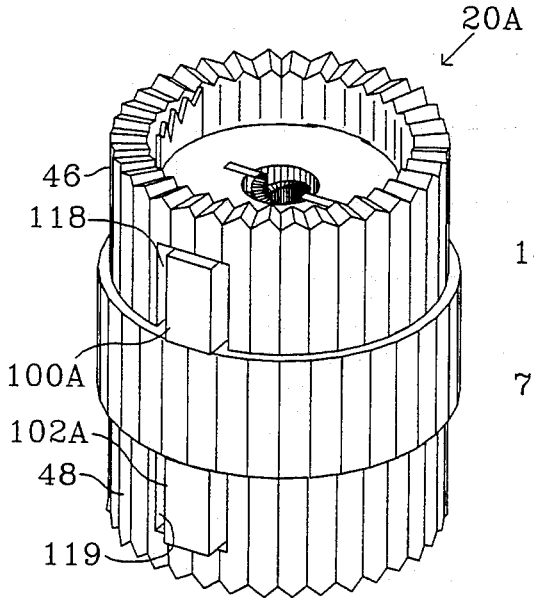
FIG. 7 is a perspective view of the FIG. 4 first and second housing extensions modified to allow limited slippage between the inner double-helix receptacles and outer double-helix receptacles.

FIG. 7 shows a modified configuration 20A of the coupler 20 wherein first and second housing projections 100A and 102A are able to move rotationally within slots 118 and 119 of sleeve housings 46 and 48, thereby providing limited slippage between either set of (inner, outer) receptacle pairs.

Referring to FIGS. 2 and 7, limited slippage between helix pairs 28A, 28B and 32A, 32B or 36A, 36B and 42A, 42B allows the continued travel of one helix after the other helix has constricted around its respective conductor.

Figure 8A:
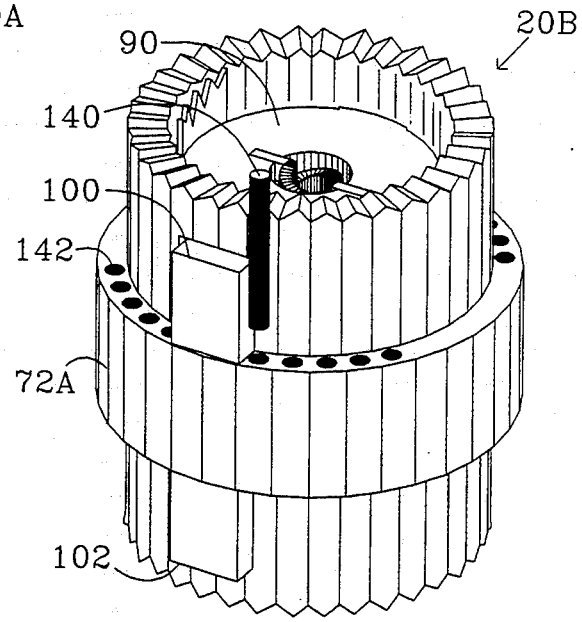
FIG. 8A is a perspective view of the FIG. 4 base, modified to include a first locking mechanism, and first and second housing extensions, and the FIG. 1 first and second sleeve housings.

FIG. 8A illustrates a first preferred method of locking housing projections 100 or 102 of coupler 20B in place, in order to keep the helix-pairs tightly constricted around their respective coaxial cable conductors. A cylindrical pin 140 inserted into one of a plurality of holes 142 in a modified base 72A prevents rotation of housings 90 and 92 (not shown) with respect to base 72A. Pin 140, retained by friction within any of the holes 142, may be threaded and subsequently screwed into a threaded hole. A single pin may be used within a hole 142 to lock both housing projections 100 and 102. Alternatively, two pins may be inserted in different holes 142, on opposing surfaces of 72A, to accommodate different angular positions of projections 100 and 102. For couplers having helix receptacles fabricated from non-resilient material, such locking is required to maintain constriction and coupling in the absence of an external torque. Couplers with receptacles fabricated from resilient material can utilize such locking mechanisms to ensure high coupling reliability, especially in strong shock and high vibration environments.

Figure 8B:
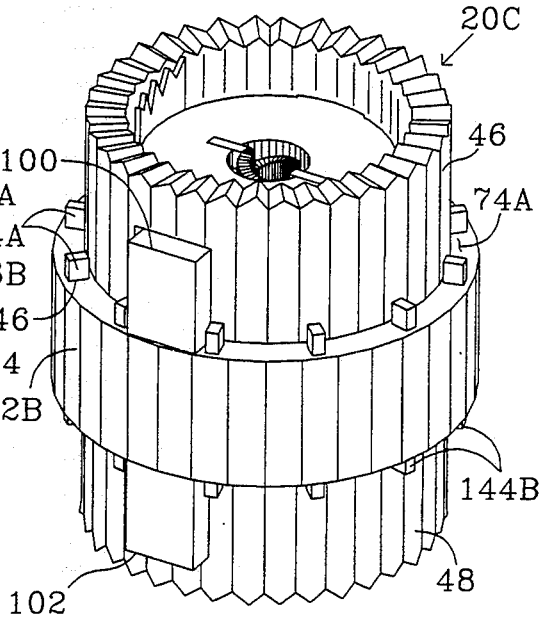
FIG. 8B is a perspective view of the FIG. 4 base, modified to include a second locking mechanism alternative to the FIG. 8A locking mechanism, the FIG. 8A first and second housing extensions, and the FIG. 1 first and second sleeve housings.

FIG. 8B shows a coupler 20C with a second preferred method of locking housing projections 100 and 102 in place. Base 72B includes first and second pluralities of depressible keys 144A and 144B disposed, respectively, around the periphery of surface 74A and surface 74B (not shown). Keys 144A, 144B are capable of being pushed flush to surface of 74A, 74B, respectively, so as to allow rotational movement of housing projections 100 and 102 past the keys. Housing projections 100 and 102 are closely received, respectively, between two of the keys 144A and 144B.

Figure 9:
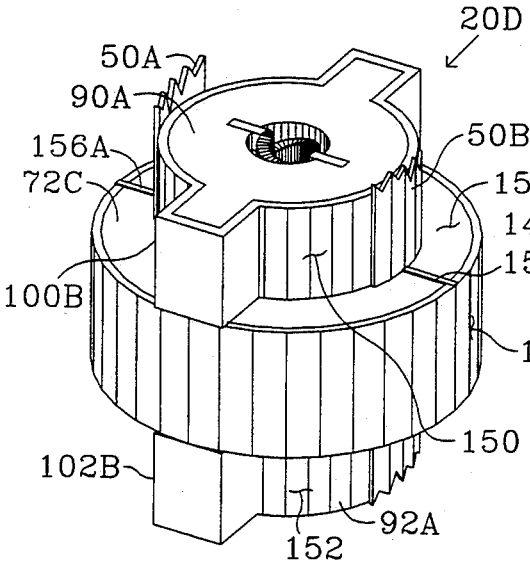
FIG. 9 is a perspective view of the FIG. 4 base, first and second housings, and first and second housing extensions, and including a partial sectional view of an exterior outer-conductor.

FIG. 9 shows a modified configuration 20D of the coupler 20 wherein first and second electrical outer-conductor shields 150, 152, conforming, respectively, to housing projections 100B, 102B, and housings 90A, 92A, are interposed between and contact, respectively, the housings and bridges 50A, 50B. A third generally cylindrical electrical outer shield 154 is generally concentric about a base 72C and is directly attached to bridge 50A and 50B, respectively, by a wire 156A and 156B. The base 72C includes first and second opposed parallel surfaces composed of shields 158A and 158B (not shown). Shields 158A and 158B are used in conjunction with 150, 152, and 154 to provide complete shield around base 72C, housing 90A and housing 92B (not shown). Addition of shielding can be extended to include the entire exterior surface of the coupler; the only provision for exterior shielding is that it does not contact the cable center-conductor. Such shielding acts to reduce radio-frequency emission-leakage at coupler junctions, and also provides a more homogeneous transition between two cables, as well as providing an even distribution of inductive and capacitive components of impedance. As different applications require different impedances, construction of a coupler will vary according to the specific application.

As an alternative to the normally closed configuration of the double-helix receptacles, the helix receptacles may be normally open with the locking mechanism as shown in FIGS. 8A or 8B keeping the helix receptacles closed after cables are inserted.

In addition, the coupler is not limited to a stand-alone configuration, but can also be panel-mounted or mounted within an electronics chassis.

III. SECOND PREFERRED EMBODIMENT

Figure 10:
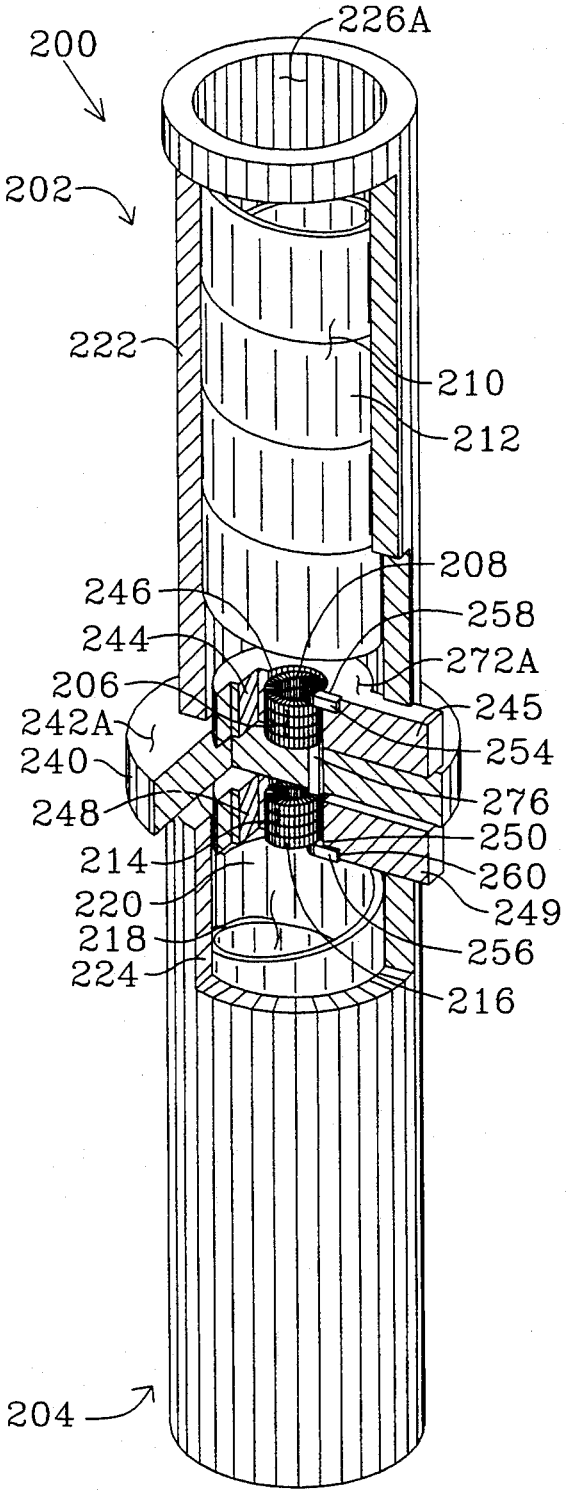
FIG. 10 is a partial sectional view of a second preferred embodiment, including opposed first and second inner single-helix receptacles, opposed first and second outer-helix receptacles, opposed first and second sleeves, a base, and opposed first and second housings.
Figure 11:
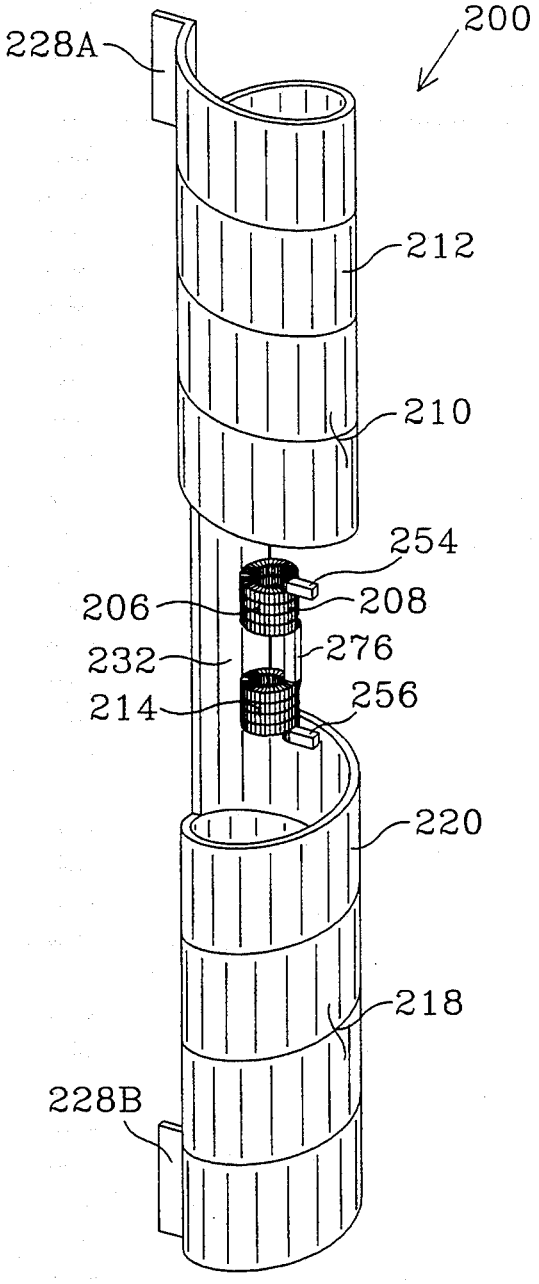
FIG. 11 is a perspective view of conductive elements of the FIG. 10 embodiment, including first and second inner helix receptacles, first and second outer helix receptacles, and first and second bridges.

As shown in FIGS. 10 and 11, a coupler 200 for connecting a bared end from each of two opposing coaxial cables includes opposed first and second receptacle sub-assemblies 202 and 204. Sub-assembly 202 includes a first inner single-helix receptacle 206 formed from a coiled bare wire 208. Receptacle 206 has an alterable circular inner cross-sectional area which can be enlarged and then contracted so as to easily receive and then constrict around and retain the bared center-conductor of a coaxial cable within the receptacle 206. Sub-assembly 202 further includes an outer single-helix receptacle 210, generally concentric around the inner receptacle 206, formed from a coiled bare wire ribbon 212. Receptacle 210 has an alterable circular inner cross-sectional area which can be enlarged and then contracted so as to easily receive and then constrict around and retain the outer conductive shield of the first coaxial cable within the receptacle 210.

Sub-assembly 204 includes a second inner single-helix receptacle 214 formed from a coiled bare wire 216. Receptacle 214 has an alterable inner cross-sectional area which can be enlarged and then contracted so as to easily receive and then constrict around and retain the bared center-conductor of a second coaxial cable within the receptacle 214. Sub-assembly 204 further includes a second outer single-helix receptacle 218, generally concentric around the inner receptacle 214, formed from a coiled bare wire ribbon 220. Receptacle 218 has an alterable circular inner cross-sectional area which can be enlarged and then contracted so as to easily receive and then constrict around and retain the outer conductive shield of the second coaxial cable within the receptacle 218.

Sub-assemblies 202 and 204 further include, respectively, generally cylindrical first and second sleeve housings 222 and 224, having, respectively, first and second interior surfaces 226A and 226B (not shown), and concentric about and closely receiving, respectively, the outer receptacles 210 and 218. First and second interior surfaces 226A and 226B (not shown) have an inner diameter slightly larger than the diameter of outer receptacles 210 and 218 in their fully opened state. The outer receptacles 210 and 218 are rigidly connected at their opposite distal ends to outer-conductor helix tabs 228A and 228B, respectively. Tabs 228A and 228B are rigidly received, respectively, within slots 230A (not shown) and 230B (not shown) in the distal ends of sleeve interior surfaces 226A and 222B. Ribbon 212 of outer receptacle 210 is rigidly connected to ribbon 220 of outer receptacle 218 at the opposed proximal ends of outer receptacles 210 and 218 by a first electrically conductive bridge 232. Rotation of sleeve housing 222 or 224 and the subsequent rotation of tabs 228A and 228B, being rigidly connected at their distal ends to outer receptacles 210 and 218, relative to bridge 232, combine to cause outer helical receptacle 210 or 218 to coil or uncoil.

Referring to FIG. 10, the coupler 200 further includes a generally cylindrical insulating base 240 having opposed parallel first and second surfaces 242A and 242B (not shown). A first generally cylindrical insulating housing 244 and housing extension 245, including therethrough a central bore 246, is fitted against and is smoothly rotatable with respect to surface 242A. A second generally cylindrical insulating housing 248 and housing extension 249, including therethrough a central bore 250, is fitted against and is smoothly rotatable with respect to surface 242B (not shown). Housing extensions 248 and 249 have limited rotation within the area unobstructed by bridge 232. Bores 246 and 250 in housings 244 and 248 each have an outer diameter slightly larger than the diameter of inner receptacles 206 and 214 in their fully opened state.

As further shown in FIGS. 10 and 11, inner receptacles 206 and 214 rigidly connected, respectively, at their opposite distal ends to center-conductor helix tabs 254 and 256. Inner receptacles 206 and 214 are closely received, respectively, within bores 246 and 250 of housings 244 and 248. Tabs 254 and 256 are closely received, respectively, within slots 258 and 260 in opposing distal surfaces 272A and 272B (not shown) of housings 244 and 248, respectively. Ribbon 208 of inner receptacle 206 is rigidly connected to ribbon 216 of inner receptacle 214 at the opposed proximal ends of inner receptacles 206 and 214 by a second electrically conductive bridge 276. Rigidity of the inner receptacles 206 and 214 at their proximal ends due to bridge 276, and constraints imposed on their distal ends by tabs 254 and 256, respectively, combine to cause inner helical receptacle 206 or 214 to coil or uncoil when housing 244 or 248 undergoes rotational displacement with respect to base 240.

As in the first embodiment, the helical receptacles of coupler 200 can be wound in a right- or left-handed manner, provided that each (inner, outer) helix pair are wound in the same direction. The single-helix configuration, when constructed of a resilient conducting material, can be normally contracted or normally open. In addition, the single-helix configuration can include provision(s) for slippage, locking, shielding, and be chassis- or panel- mounted, all in a manner similar to provision(s) for the double-helix configuration.

IV. HELIX FABRICATION METHODS

Square, rectangular, or round stock may be used in fabricating inner single- or double-helix receptacles. Fabrication methods are similar to those described in the '726 patent which use a rotating rod-toolset to wrap a helix onto itself.

Figure 12A:
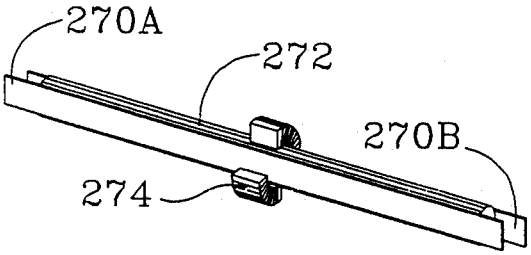
FIGS. 12A–12F show six steps in constructing a double-helix receptacle such as those used in the FIG. 1 embodiment.

Fabrication of outer double helix receptacles according to the present invention is shown in FIGS. 12A–12F. Referring to FIG. 12A, two appropriately sized lengths 270A, 270B of an electrically conductive ribbon material are positioned alongside a rotating tool 272 including a catch 274. The ribbons 270A, 270B are caught in and bent within the catch 274.

Figure 12B:
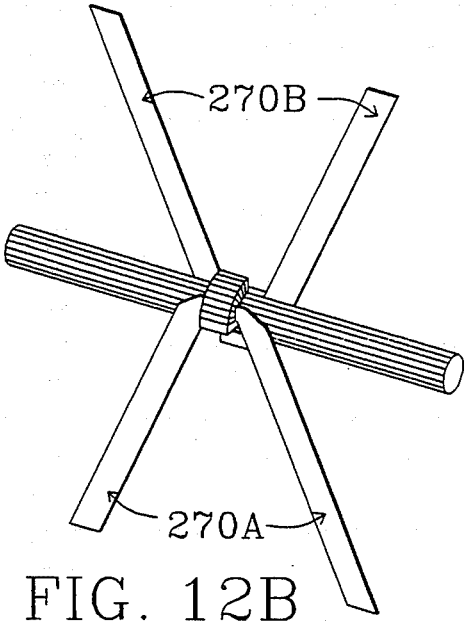

In FIG. 12B, the ribbons are initially bent and suitably angled to provide an appropriate pitch. Alternatively, the shape of ribbons 270A and 270B can be stamped out from a sheet of appropriate conductive material, thereby bypassing the bending step between steps 12A and 12B. A stamped-out form of this nature can provide any desired shape and contour to support the pitch and dimensional requirements of the helix.

Figure 12C:
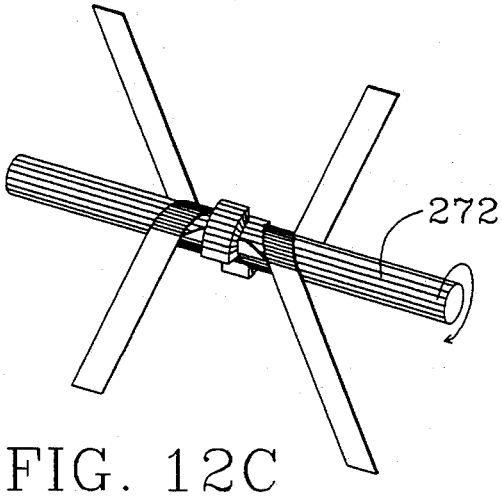
Figure 12D:
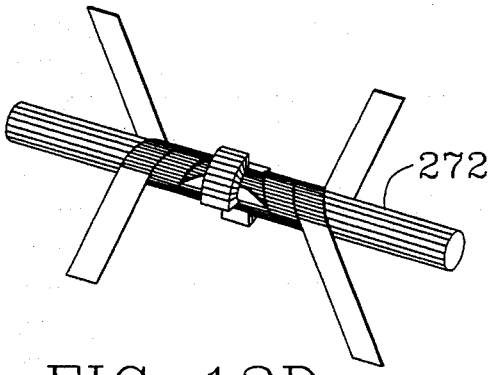
Figure 12E:
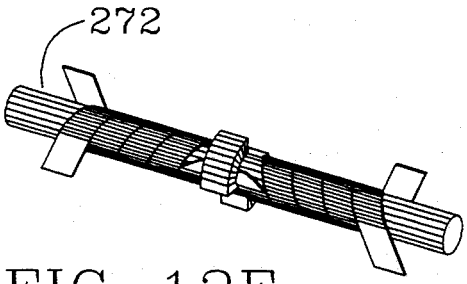
Figure 12F:
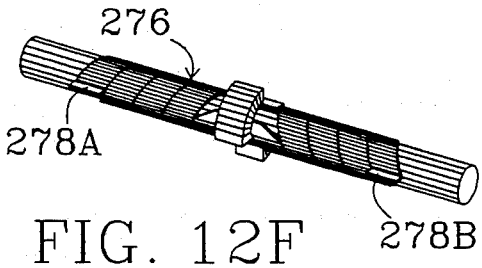

FIGS. 12C, 12D and 12E show three successive stages in forming an outer double-helix receptacle as the tool 272 undergoes axial rotation. FIG. 12F shows a fully-formed double-helix receptacle 276 including first and second tabs 278A, 278B.

The electrically conductive material used for inner or outer-helix fabrication can be resilient or non-resilient.

The type of material used depends on intended applications of a particular coupler.

What is claimed is:

1. A coupler of the zero insertion force type for electrically and mechanically connecting a bared end of a first coaxial cable including a center-conductor and outer conductive shield, with a bared end of a second coaxial cable including a center-conductor and outer conductive shield, the coupler comprising:

a first generally cylindrical receptacle formed from at least one predetermined length of helically coiled, electrically conductive material, and having in the absence of an externally applied torque a predetermined inner cross-sectional area approximate to the cross-sectional area of the center-conductor of the first coaxial cable;

a second generally cylindrical receptacle formed from at least one predetermined length of helically coiled, electrically conductive material, the receptacle generally concentric about the first receptacle, and having in the absence of an externally applied torque a predetermined inner cross-sectional area approximate to the cross-sectional area of the outer conductive shield of the first coaxial cable;

a third generally cylindrical receptacle formed from at least one predetermined length of helically coiled, electrically conductive material, and having in the absence of an externally applied torque a predetermined inner cross-sectional area approximate to the cross-sectional area of the center-conductor of the second coaxial cable, said receptacle disposed generally opposite to the first receptacle;

a fourth generally cylindrical receptacle formed from at least one predetermined length of helically coiled, electrically conductive material, and having in the absence of an externally applied torque a predetermined inner cross-sectional area approximate to the cross-sectional area of the outer conductive shield of the second coaxial cable, said receptacle disposed generally opposite to the second receptacle;

means for electrically and mechanically connecting the first and third receptacles, said means comprising at least one rigid, electrically conductive bridge;

means for electrically and mechanically connecting the second and fourth receptacles, said means comprising at least one rigid, electrically conductive bridge;

means for enlarging the inner cross-sectional areas of the first and second receptacles;

means for contracting the inner cross-sectional areas of the first and second receptacles;

means for enlarging the inner cross-sectional areas of the third and fourth receptacles; and means for contracting the inner cross-sectional areas of the third and fourth receptacles.

2. The coupler of claim 1, wherein the inner cross-sectional areas of the first and second receptacles are smaller, respectively, than the cross-sectional areas of the center-conductor and outer conductive shield of the first coaxial cable, said means for enlarging the inner cross-sectional areas of the first and second receptacles comprising applying a torque normal to a common longitudinal axis of the receptacles.

3. The coupler of claim 1, wherein the inner cross-sectional areas of the first and second receptacles are larger, respectively, than the cross-sectional areas of the center-conductor and outer conductive shield of the first coaxial cable, said means for contracting the inner cross-sectional areas of the first and second receptacles comprising applying a torque normal to a common longitudinal axis of the receptacles.

4. The coupler of claim 1, wherein the inner cross-sectional areas of the third and fourth receptacles are smaller, respectively, than the cross-sectional areas of the center-conductor and outer conductive shield of the second coaxial cable, said means for enlarging the inner cross-sectional areas of the third and fourth receptacles comprising applying a torque normal to a common longitudinal axis of the receptacles.

5. The coupler of claim 1, wherein the inner cross-sectional areas of the third and fourth receptacles are larger, respectively, than the cross-sectional inner areas of the center-conductor and outer conductive shield of the second coaxial cable, said means for contracting the inner cross-sectional areas of the third and fourth receptacles comprising applying a torque normal to a common longitudinal axis of the receptacles.

6. The coupler of claim 1, further comprising means to increase the electrical shielding of the coupler, said means comprising surrounding the coupler with an electrically conductive shield, the shield electrically isolated from the first and third receptacles, and electrically connected to the second and fourth receptacles.

7. The coupler of claim 1, further comprising:

a generally cylindrical base having parallel first and second surfaces of a predetermined diameter and a predetermined inter-surface thickness, the base symmetrically disposed between the first and second, and third and fourth receptacles;

first and second generally cylindrical housings rigidly retaining the first and third receptacles, respectively, the housings fitting against and smoothly rotatable, respectively, relative to the first and second surfaces of the base;

first and second housing projections rigidly attached to, respectively, the first and second housings; and first and second generally cylindrical sleeve housings each including first and second apertures to retain, respectively, first and second housing projections, with said sleeve housings rigidly retaining, respectively, the second and fourth receptacles and the first and second housing projections, with the sleeve housings fitting against and smoothly rotatable, respectively, relative to the first and second surfaces of the base.

8. The coupler of claim 7, further comprising means for independently locking the first and second receptacles, and third and fourth receptacles, said means comprising a plurality of holes therethrough the base, with first and second locking pins disposed within first and second holes selected from among the plurality of holes.

9. The coupler of claim 7, further comprising means for providing rotational slippage between the first and second receptacles, and third and fourth receptacles, said means comprising of modified first and second housing projections loosely retained within, respectively, the first and second apertures.

10. A coupler of the zero insertion force type for electrically and mechanically connecting a bared end of a first coaxial cable including a center-conductor and an outer conductive shield, with a bared end of a second coaxial cable including a center-conductor and an outer conductive shield, the coupler comprising:

a first generally cylindrical receptacle formed from two predetermined lengths of helically coiled, interleaved, electrically conductive wire, the receptacle having in the absence of an externally applied torque a predetermined inner cross-sectional area approximate to the cross-sectional area of the center-conductor of the first coaxial cable;

a second generally cylindrical receptacle formed from two predetermined lengths of helically coiled, interleaved, electrically conductive wire ribbon, the receptacle generally concentric about the first receptacle and having in the absence of an externally applied torque a predetermined inner cross-sectional area approximate to the cross-sectional area of the outer conductive shield of the first coaxial cable;

a third generally cylindrical receptacle formed from two predetermined lengths of helically coiled, interleaved, electrically conductive wire, the receptacle having in the absence of an externally applied torque a predetermined inner cross-sectional area approximate to the cross-sectional area of the center-conductor of the second coaxial cable, said receptacle disposed generally opposite to the first receptacle;

a fourth generally cylindrical receptacle formed from two predetermined lengths of helically coiled, interleaved, electrically conductive wire ribbon, the receptacle generally concentric about the third receptacle and having in the absence of an externally applied torque a predetermined inner cross-sectional area approximate to the cross-sectional area of the outer-conductive shield of the second coaxial cable, said receptacle disposed generally opposite to the second receptacle;

means for electrically and mechanically connecting the first and third receptacles, said means comprising first and second rigid, electrically conductive bridges;

means for electrically and mechanically connecting the second and fourth receptacles, said means comprising third and fourth rigid, electrically conductive bridges;

means for concurrently enlarging the inner cross-sectional areas of the first and second receptacles;

means for concurrently contracting the inner cross-sectional areas of the first and second receptacles;

means for concurrently enlarging the inner cross-sectional areas of the third and fourth receptacles; and means for concurrently contracting the inner cross-sectional areas of the third and fourth receptacles.

11. The coupler of claim 10, wherein the inner cross-sectional areas of the first and second receptacles, are smaller, respectively, than the cross-sectional areas of the center-conductor and outer conductive shield of the first coaxial cable, said means for concurrently enlarging the inner cross-sectional areas of the first and second receptacles comprising applying a torque normal to a common longitudinal axis of the receptacles.

12. The coupler of claim 10, wherein the inner cross-sectional areas of the first and second receptacles are larger, respectively, than the cross-sectional areas of the center-conductor and outer conductive shield of the first coaxial cable, said means for concurrently contracting the inner cross-sectional areas of the first and second receptacles comprising applying a torque normal to a common longitudinal axis of the receptacles.

13. The coupler of claim 10, wherein the inner cross-sectional areas of the third and fourth receptacles are smaller, respectively, than the cross-sectional areas of the center-conductor and outer conductive shield of the second coaxial cable, said means for concurrently enlarging the inner cross-sectional areas of the third and fourth receptacles comprising applying a torque normal to a common longitudinal axis of the receptacles.

14. The coupler of claim 10, wherein the inner cross-sectional of the third and fourth receptacles are larger, respectively, than the cross-sectional inner areas of the center-conductor and outer conductive shield respectively of the second coaxial cable, said means for contracting the inner cross-sectional areas of the third and fourth receptacles comprising applying a torque normal to a common longitudinal axis of the receptacles.

15. The coupler of claim 10, further comprising means to increase the electrical shielding of the coupler, said means comprising surrounding the coupler with an electrically conductive shield, the shield electrically isolated from the first and third receptacles, and electrically connected to the second and fourth receptacles.

16. The coupler of claim 10, further comprising:

a generally cylindrical base having parallel first and second surfaces of a predetermined diameter and a predetermined inter-surface thickness, the base symmetrically disposed between the first and second, and third and fourth receptacles;

first and second generally cylindrical housings rigidly retaining the first and third receptacles, respectively, the housings fitting against and smoothly rotatable, respectively, relative to the first and second surfaces of the base;

first and second housing projections rigidly attached to, respectively, the first and second housings; and first and second generally cylindrical sleeve housings each including first and second apertures to retain, respectively, first and second housing projections, with said sleeve housings rigidly retaining, respectively, the second and fourth receptacles and the first and second housing projections, with the sleeve housings fitting against and smoothly rotatable, respectively, relative to the first and second surfaces of the base.

17. The coupler of claim 16, further comprising means for independently locking the first and second receptacles, and third and fourth receptacles, said means comprising a plurality of holes therethrough the base, with first and second locking pins disposed within first and second holes selected from among the plurality of holes.

18. The coupler of claim 16, further comprising means for providing rotational slippage between the first and second receptacles, and third and fourth receptacles, said means comprising of modified first and second housing projections loosely retained within, respectively, the first and second apertures.

19. A coupler of the zero insertion force type for electrically and mechanically connecting a bared end of a first coaxial cable including a center-conductor and an outer conductive shield, with a bared end of a second coaxial cable including a center-conductor and an outer conductive shield, the coupler comprising:

a first generally cylindrical receptacle formed from a predetermined length of helically coiled, electrically conductive wire, the receptacle having in the absence of an externally applied torque a predetermined inner cross-sectional area approximate to the cross-sectional area of the center-conductor of the first coaxial cable;

a second generally cylindrical receptacle formed from a predetermined length of helically coiled, electrically conductive wire ribbon, the receptacle generally concentric about the first receptacle and having in the absence of an externally applied torque a predetermined inner cross-sectional area approximate to the cross-sectional area of the outer conductive shield of the first coaxial cable;

a third generally cylindrical receptacle formed from a predetermined length of helically coiled, electrically conductive wire, the receptacle having in the absence of an externally applied torque a predetermined inner cross-sectional area approximate to the cross-sectional area of the center-conductor of the second coaxial cable, said receptacle disposed generally opposite to the first receptacle;

a fourth generally cylindrical receptacle formed from a predetermined length of helically coiled, electrically conductive wire ribbon, the receptacle generally concentric about the third receptacle and having in the absence of an externally applied torque a predetermined inner cross-sectional area approximate to the cross-sectional area of the outer conductive shield of the second coaxial cable, said receptacle disposed generally opposite to the second receptacle;

means for electrically and mechanically connecting the first and third receptacles, said means comprising a first rigid, electrically conductive bridge;

means for electrically and mechanically connecting the second and fourth receptacles, said means comprising a second rigid, electrically conductive bridge;

means for concurrently enlarging the inner cross-sectional areas of the first and second receptacles;

means for concurrently contracting the inner cross-sectional areas of the first and second receptacles;

means for concurrently enlarging the inner cross-sectional areas of the third and fourth receptacles; and means for concurrently contracting the inner cross-sectional areas of the third and fourth receptacles.

20. The coupler of claim 19, wherein the inner cross-sectional areas of the first and second receptacles are smaller, respectively, than the cross-sectional areas of the center-conductor and outer conductive shield of the first coaxial cable, said means for concurrently enlarging the inner cross-sectional areas of the first and second receptacles comprising applying a torque normal to a common longitudinal axis of the receptacles.

21. The coupler of claim 19, wherein the inner cross-sectional areas of the first and second receptacles are larger, respectively, than the cross-sectional areas of the center-conductor and outer conductive shield of the first coaxial cable, said means for concurrently contracting the inner cross-sectional areas of the first and second receptacles comprising applying a torque normal to a common longitudinal axis of the receptacles.

22. The coupler of claim 19, wherein the inner cross-sectional areas of the third and fourth receptacles are smaller, respectively, than the cross-sectional areas of the center-conductor and outer conductive shield of the second coaxial cable, said means for concurrently enlarging the inner cross-sections of the third and fourth receptacles comprising applying a torque normal to a common longitudinal axis of the receptacles.

23. The coupler of claim 19, wherein the inner cross-sectional areas of the third and fourth receptacles are larger, respectively, than the cross-sectional areas of the center-conductor and outer conductive shield of the second coaxial cable, said means for contracting the inner cross-sectional areas of the third and fourth receptacles comprises applying a torque normal to a common longitudinal axis of the receptacles

24. The coupler of claim 19, further comprising means to increase the electrical shielding of the coupler, said means comprising surrounding the coupler with an electrically conductive shield, the shield electrically isolated from the first and third receptacles, and electrically connected to the second and fourth receptacles.

25. The coupler of claim 19, further comprising:

a generally cylindrical base having parallel first and second surfaces of a predetermined diameter and a predetermined inter-surface thickness, the base symmetrically disposed between the first and second, and third and fourth receptacles;

first and second generally cylindrical housings rigidly retaining the first and third receptacles, respectively, the housings fitting against and smoothly rotatable, respectively, relative to the first and second surfaces of the base;

first and second housing projections rigidly attached to, respectively, the first and second housings; and first and second generally cylindrical sleeve housings each including first and second apertures to retain, respectively, first and second housing projections, with said sleeve housings rigidly retaining, respectively, the second and fourth receptacles and the first and second housing projections, with the sleeve housings fitting against and smoothly rotatable, respectively, relative to the first and second surfaces of the base.

26. The coupler of claim 25, further comprising means for independently locking the first and second receptacles, and third and fourth receptacles, said means comprising a plurality of holes therethrough the base, with first and second locking pins disposed within first and second holes selected from among the plurality of holes.

27. The coupler of claim 25, further comprising means for providing rotational slippage between the first and second receptacles, and third and fourth receptacles, said means comprising of modified first and second housing projections loosely retained within, respectively, the first and second apertures.

28. A coupler of the zero insertion force type for electrically and mechanically connecting a bared end of a first coaxial cable including a center-conductor and an outer conductive shield, with a bared end of a second coaxial cable including a center-conductor and an outer conductive shield, the coupler comprising:

a first generally cylindrical receptacle formed from two predetermined lengths of helically coiled, interleaved, electrically conductive wire, the receptacle having in the absence of an externally applied torque a contracted inner cross-sectional area so as to contact and rigidly grip the center-conductor of the first coaxial cable;

a second generally cylindrical receptacle formed from two predetermined lengths of helically coiled, interleaved, electrically conductive wire ribbon, the receptacle generally concentric about the first receptacle and having in the absence of an externally applied torque a contracted inner cross-sectional area so as to contact and rigidly grip the outer-conductive shield of the first coaxial cable;

a third generally cylindrical receptacle formed from two predetermined lengths of helically coiled, interleaved, electrically conductive wire, the receptacle having in the absence of an externally applied torque a contracted inner cross-sectional area so as to contact and rigidly grip the center-conductor of the second coaxial cable, said receptacle disposed generally opposite to the first receptacle;

a fourth generally cylindrical receptacle formed from two predetermined lengths of helically coiled, interleaved, electrically conductive wire ribbon, the receptacle generally concentric about the third receptacle and having in the absence of an externally applied torque a contracted inner cross-sectional area so as to contact and rigidly grip the outer conductive shield of the second coaxial cable, said receptacle disposed generally opposite to the second receptacle;

first and second generally cylindrical sleeve housings each including an interior surface, the sleeve housings generally concentric, respectively, about the second and fourth receptacles, and the receptacles rigidly attached at opposing distal ends, respectively, to the interior surfaces;

a generally cylindrical base having parallel first and second surfaces of a predetermined diameter and a predetermined inter-surface thickness, the base symmetrically disposed between the first and second, and third and fourth receptacles;

first and second generally cylindrical housings each having a central bore therethrough, fitting against and smoothly rotatable relative to, respectively, the first and second surfaces of the base, the first and third cylindrical receptacles disposed, respectively, within the first and second bores, the receptacles rigidly attached at opposed distal ends to, respectively, the first and second housings;

first and second housing projections rigidly attached to, respectively, the first and second housings;

first and second rigid, electrically conductive bridges attached to opposed proximal ends of the first and third receptacles; and third and fourth rigid, electrically conductive bridges attached to opposed proximal ends of the second and fourth receptacles.

29. The coupler of claim 28, wherein the first, second, third and fourth receptacles are formed from a resilient material.

30. A coupler of the zero insertion force type for electrically and mechanically connecting a bared end of a first coaxial cable including a center-conductor and a outer-conductive shield, with a bared end of a second coaxial cable including a center-conductor and an outer conductive shield, the coupler comprising:

a first generally cylindrical receptacle formed from a predetermined length of helically coiled, electrically conductive wire, the receptacle having in the absence of an externally applied torque a contracted inner cross-sectional area so as to contact and rigidly grip the center-conductor of the first coaxial cable;

a second generally cylindrical receptacle formed from a predetermined length of helically coiled, electrically conductive wire ribbon, the receptacle generally concentric about the first receptacle and having in the absence of an externally applied torque a contracted inner cross-sectional area so as to contact and rigidly grip the outer conductive shield of the first coaxial cable;

a third generally cylindrical receptacle formed from a predetermined length of helically coiled, electrically conductive wire, the receptacle having in the absence of an externally applied torque a contracted inner cross-sectional area so as to contact and rigidly grip the center-conductor of the second coaxial cable, said receptacle disposed generally opposite to the first receptacle;

a fourth generally cylindrical receptacle formed from a predetermined length of helically coiled, electrically conductive wire ribbon, the receptacle generally concentric about the third receptacle and having in the absence of an externally applied torque a contracted inner cross-sectional area so as to contact and rigidly grip the outer conductive shield of the second coaxial cable, said receptacle disposed generally opposite to the second receptacle;

first and second generally cylindrical sleeve housings each including an interior surface, the sleeve housings generally concentric, respectively, about the second and fourth receptacles, and the receptacles rigidly attached at opposing distal ends, respectively, to the interior surfaces;

a generally cylindrical base having parallel first and second surfaces of a predetermined diameter and a predetermined inter-surface thickness, the base symmetrically disposed between the first and second, and third and fourth receptacles;

first and second generally cylindrical housings each having a central bore therethrough, fitting against and smoothly rotatable relative to, respectively, the first and second surfaces of the base, the first and third cylindrical receptacles disposed, respectively, within the first and second bores, and the receptacles rigidly attached at opposed distal ends to, respectively, the first and second housings;

first and second housing projections rigidly attached to, respectively, the first and second housings;

a first rigid, electrically conductive bridge attached to opposed proximal ends of the first and third receptacles; and a second rigid, electrically conductive bridge attached to opposed proximal ends of the second and fourth receptacles.

31. The coupler of claim 30, wherein the first, second, third and fourth receptacles are formed from a resilient material.

* * * * *